US011635209B2

(12) United States Patent
Vukanti et al.

(10) Patent No.: US 11,635,209 B2
(45) Date of Patent: Apr. 25, 2023

(54) GAS TURBINE COMBUSTOR DOME WITH INTEGRATED FLARE SWIRLER

(71) Applicant: General Electric Company, Schenectady, NY (US)

(72) Inventors: Perumallu Vukanti, Bengaluru (IN); Pradeep Naik, Bengaluru (IN); Sripathi Mohan, Bengaluru (IN); Karthikeyan Sampath, Bengaluru (IN); Steven C. Vise, Loveland, OH (US); Shai Birmaher, Cincinnati, OH (US); Saket Singh, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/649,128

(22) Filed: Jan. 27, 2022

(65) Prior Publication Data

US 2023/0053389 A1 Feb. 23, 2023

(30) Foreign Application Priority Data

Aug. 23, 2021 (IN) ..... 202111038058

(51) Int. Cl.
*F23R 3/14* (2006.01)
*F23R 3/28* (2006.01)
*F23R 3/16* (2006.01)

(52) U.S. Cl.
CPC ..... *F23R 3/14* (2013.01); *F23R 3/16* (2013.01); *F23R 3/286* (2013.01)

(58) Field of Classification Search
CPC ..... F23R 3/14; F23R 3/16; F23R 3/286
See application file for complete search history.

(56) References Cited

U.S. PATENT DOCUMENTS 4,180,974 A * 1/1980 Stenger ..... F23R 3/14 60/756
4,198,815 A * 4/1980 Bobo ..... F23R 3/14 60/737
4,842,197 A * 6/1989 Simon ..... F23D 11/107 239/406
5,154,060 A * 10/1992 Walker ..... F23R 3/50 60/746
5,197,290 A * 3/1993 Lee ..... F23R 3/26 60/794
5,417,070 A * 5/1995 Richardson ..... F23R 3/14 239/406
5,490,378 A * 2/1996 Berger ..... F23R 3/14 60/39.23
5,603,211 A * 2/1997 Graves ..... F23C 7/002 60/776
5,816,050 A * 10/1998 Sjunnesson ..... F23R 3/14 60/737

(Continued)

*Primary Examiner* — William H Rodriguez
(74) *Attorney, Agent, or Firm* — Venable LLP; Edward A. Kmett; Michel V. Frank

(57) ABSTRACT

A swirler assembly includes a swirler having a primary swirler and a secondary swirler, and a flare connected the secondary swirler, and a dome disposed radially outward of the flare. A flare oxidizer flow passage is defined by a flare outer surface and a dome inner surface, and the flare oxidizer flow passage includes a swirl inducing member therewithin that induces a swirled flow of an oxidizer passing through the flare oxidizer flow passage into a combustion chamber.

20 Claims, 10 Drawing Sheets

(56) References Cited

U.S. PATENT DOCUMENTS 6,035,645 A * 3/2000 Bensaadi ..... F23R 3/14 60/742
6,212,870 B1 * 4/2001 Thompson ..... F23R 3/60 60/746
6,442,940 B1 * 9/2002 Young ..... F23R 3/14 29/890.01
6,546,732 B1 * 4/2003 Young ..... F23D 14/78 60/740
6,581,386 B2 6/2003 Young et al.
6,834,505 B2 12/2004 Al-Roub et al.
6,932,093 B2 8/2005 Ogden et al.
6,959,551 B2 11/2005 Baudoin et al.
7,246,494 B2 7/2007 Currin et al.
7,654,091 B2 2/2010 Al-Roub et al.
8,783,038 B2 7/2014 Horikawa et al.
10,801,726 B2 10/2020 Stevens et al.
2004/0163678 A1 * 8/2004 Ogden ..... F23D 11/386 134/167 R
2005/0097889 A1 * 5/2005 Pilatis ..... F23D 11/107 60/743
2005/0262843 A1 * 12/2005 Monty ..... F23R 3/28 60/748
2007/0033950 A1 * 2/2007 Bernier ..... F23R 3/14 60/740
2007/0119052 A1 * 5/2007 Caldwell ..... B23P 6/005 29/888.011
2007/0125085 A1 * 6/2007 Commaret ..... F23R 3/14 60/748
2009/0173076 A1 * 7/2009 Toon ..... F23R 3/286 60/746
2010/0242484 A1 9/2010 Suleiman et al.
2013/0020413 A1 * 1/2013 Jones ..... F23D 11/383 239/533.2
2013/0036739 A1 * 2/2013 Horikawa ..... F23R 3/28 60/735
2014/0241871 A1 * 8/2014 Gregory ..... F23C 7/004 415/208.1
2020/0025386 A1 * 1/2020 Muldal ..... F23R 3/343
2020/0191394 A1 * 6/2020 Tentorio ..... F23R 3/286

* cited by examiner

GAS TURBINE COMBUSTOR DOME WITH INTEGRATED FLARE SWIRLER

CROSS REFERENCE TO RELATED APPLICATIONS

The present application claims the benefit of Indian Patent Application No. 202111038058, filed on Aug. 23, 2021, which is hereby incorporated by reference herein in its entirety.

TECHNICAL FIELD

The present disclosure relates to a swirler assembly of a combustor of a gas turbine engine having a dome with an integrated flare swirler.

BACKGROUND

Some conventional gas turbine engines are known to include rich-burn combustors that typically use a swirler integrated with a fuel nozzle to deliver a swirled fuel-air mixture to a combustor. A radial-radial swirler is one example of such a swirler and includes a primary radial swirler, a secondary radial swirler, a flare connected to the secondary swirler, and a dome connected radially outward of the flare. The primary swirler includes a primary swirler venturi in which a primary flow of swirled air from the primary swirler mixes with fuel injected into the primary swirler venturi by the fuel nozzle, thereby generating a swirled primary fuel-air mixture. The secondary swirler provides a secondary flow of swirled air downstream of the primary swirler, where the secondary flow of swirled air mixes with the swirled primary fuel-air mixture, thereby generating a swirled fuel-air mixture. The swirled fuel-air mixture then flows downstream to the flare connected to a downstream end of the secondary swirler. The flare generally has a conical outlet that disperses the swirled secondary fuel-air mixture into the combustion chamber, where it is ignited and burned to generate combustion product gases. Some rich-burn combustors also include a flare purge in which cooling air is provided via axial holes or radially inward holes between the flare and the dome to provide impingement cooling to the backside of the flare.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
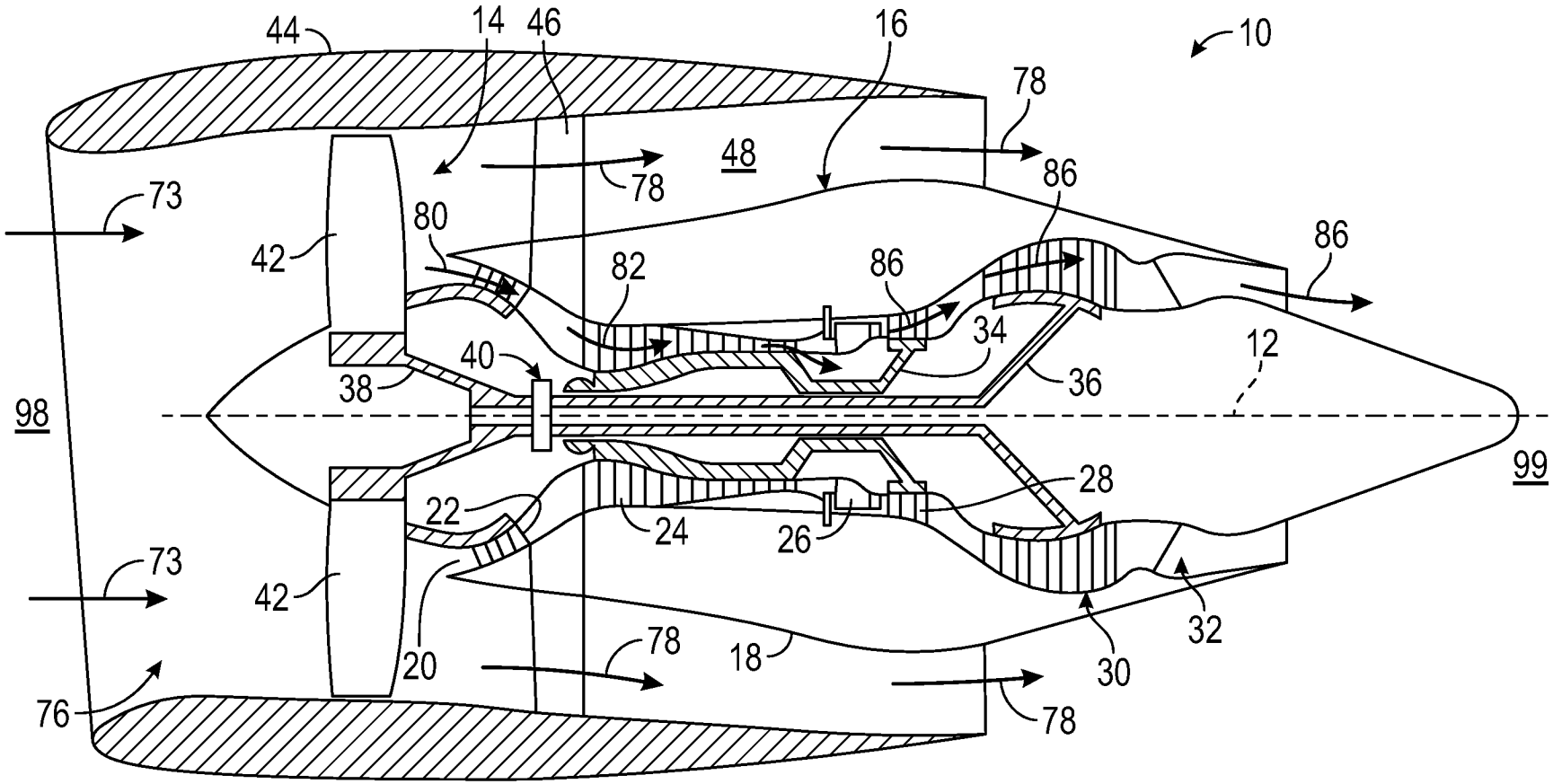
FIG. 1 is a schematic partial cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, it is to be understood that the following detailed description are exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a rich-burn combustor that includes a radial-radial swirler, air is provided from a pressure plenum of a combustor to a swirler assembly, where a swirl is induced in the air by swirl vanes of both a primary swirler and a secondary swirler. Fuel is injected into the swirled air of the primary swirler, and the swirled primary fuel-air mixture then flows to the secondary swirler, where it is further mixed with swirled air from the secondary swirler. The secondary swirled fuel-air mixture then flows downstream to the flare cone, where it is expanded and dispersed into a combustion chamber, and then ignited and burned to generate combustion product gases. The flare may be surrounded by a dome, or deflector wall, and a flare purge cavity may be formed between the dome and the flare. The flare purge cavity may include axial holes or radially inward holes to allow impingement cooling air to pass between the flare outer surface and the dome so as to provide impingement cooling to the flare outer tip. The flare purge impingement cooling flow, however, does not provide sufficient turbulence, mixing, or flame strain at the flame front near the flare exit and the dome inner surface, resulting in local higher regions of hot spots that increase NOx emissions.

The present disclosure addresses the foregoing by inducing a swirled flow of oxidizer between the flare and the dome. More particularly, an oxidizer flow passage provided between the flare outer surface and the dome inner surface includes a swirl inducing member, such as a plurality of swirl vanes arranged about the circumference of the flare. The swirl vanes induce a swirl into the flow of oxidizer passing through the oxidizer flow passage, such that a swirled flare oxidizer flow exits the passage. The swirled flare oxidizer flow provides for higher turbulence and better mixing at the flame front near the flare exit, thereby reducing NOx emissions. The swirled flare oxidizer flow also stays closer to the dome plane so as to provide better cooling of the dome surface.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a ducted turbofan engine, the present disclosure is also applicable to turbomachinery in general, including turbojet, turboprop, and turboshaft gas turbine engines, including marine and industrial turbine engines and auxiliary power units. In addition, the present disclosure is not limited to ducted fan type turbine engines such as that shown in FIG. 1, but can be implemented in unducted fan (UDF) type turbine engines. As shown in FIG. 1, the engine 10 has a longitudinal or axial centerline axis 12 that extends therethrough from an upstream end 98 to a downstream end 99 for reference purposes. In general, the engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
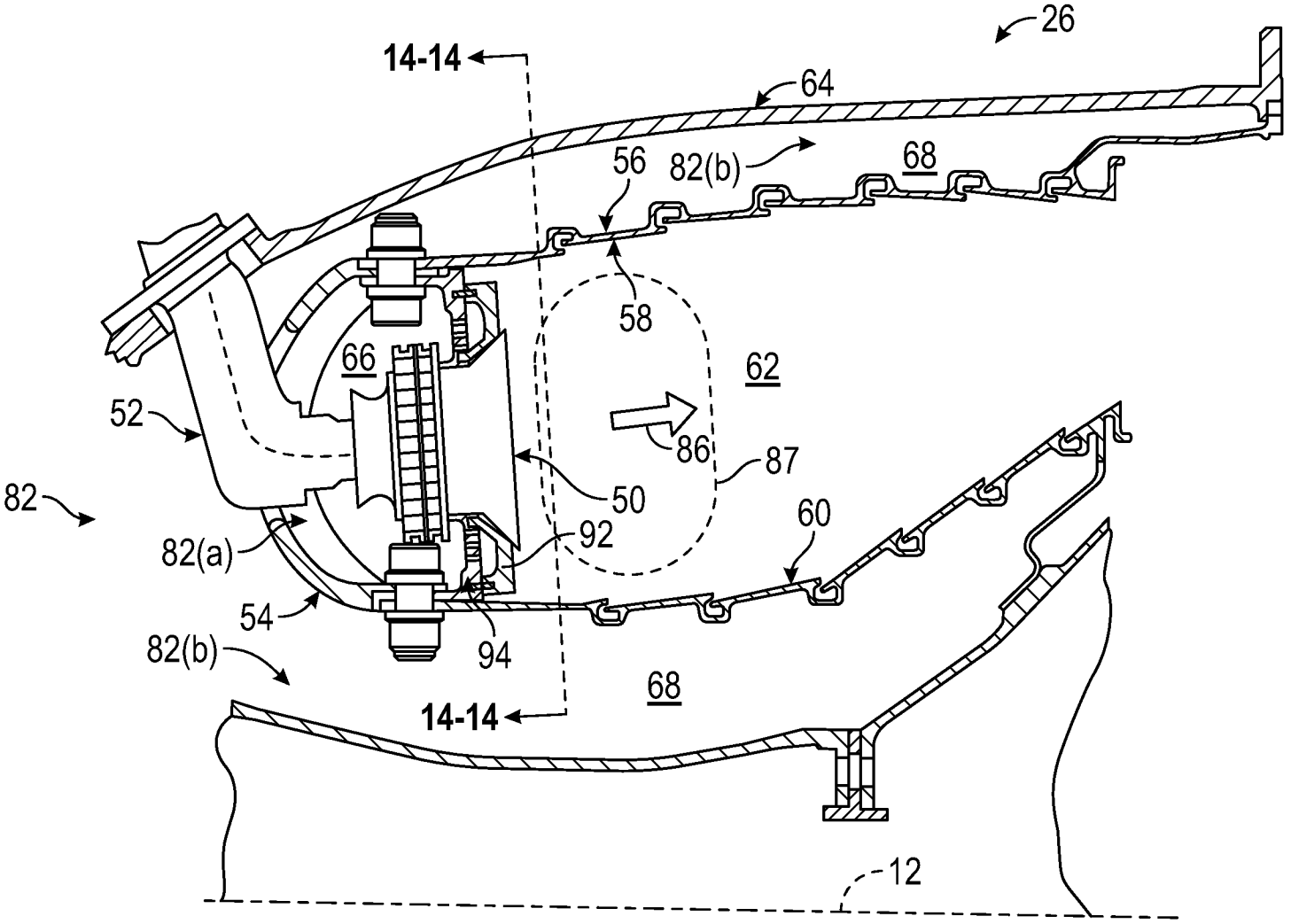
FIG. 2 is a partial cross-sectional side view of an exemplary combustion section, according to an aspect of the present disclosure.

FIG. 2 depicts an exemplary combustion section 26 according to the present disclosure. In FIG. 2, the combustion section 26 includes a swirler assembly 50, a fuel nozzle assembly 52, a dome assembly 54, and an annular combustion liner 56 within an outer casing 64. The annular combustion liner 56 includes an outer liner 58 and an inner liner 60 forming a combustion chamber 62 therebetween. A pressure plenum 66 is formed within the dome assembly 54. Referring back to FIG. 1, in operation, air 73 enters the nacelle 44, and a portion of the air 73 enters the compressor section as compressor inlet air flow 80, where it is compressed. Another portion of the air 73 enters the bypass airflow passage 48, thereby providing a bypass airflow 78. In FIG. 2, compressed air 82 from the compressor section (22/24) enters the combustion section 26 via a diffuser (not shown). A portion of the compressed air 82(*a*) enters the dome assembly 54 to the pressure plenum 66, while another portion of the compressed air 82(*b*) passes to an outer flow passage 68 between the annular combustion liner 56 and the outer casing 64. As will be described below, the portion of the compressed air 82(*a*) in the pressure plenum 66 passes through the swirler assembly 50 to mix with fuel injected by the fuel nozzle assembly 52 and is ignited to generate combustion product gases 86.

Figure 3:
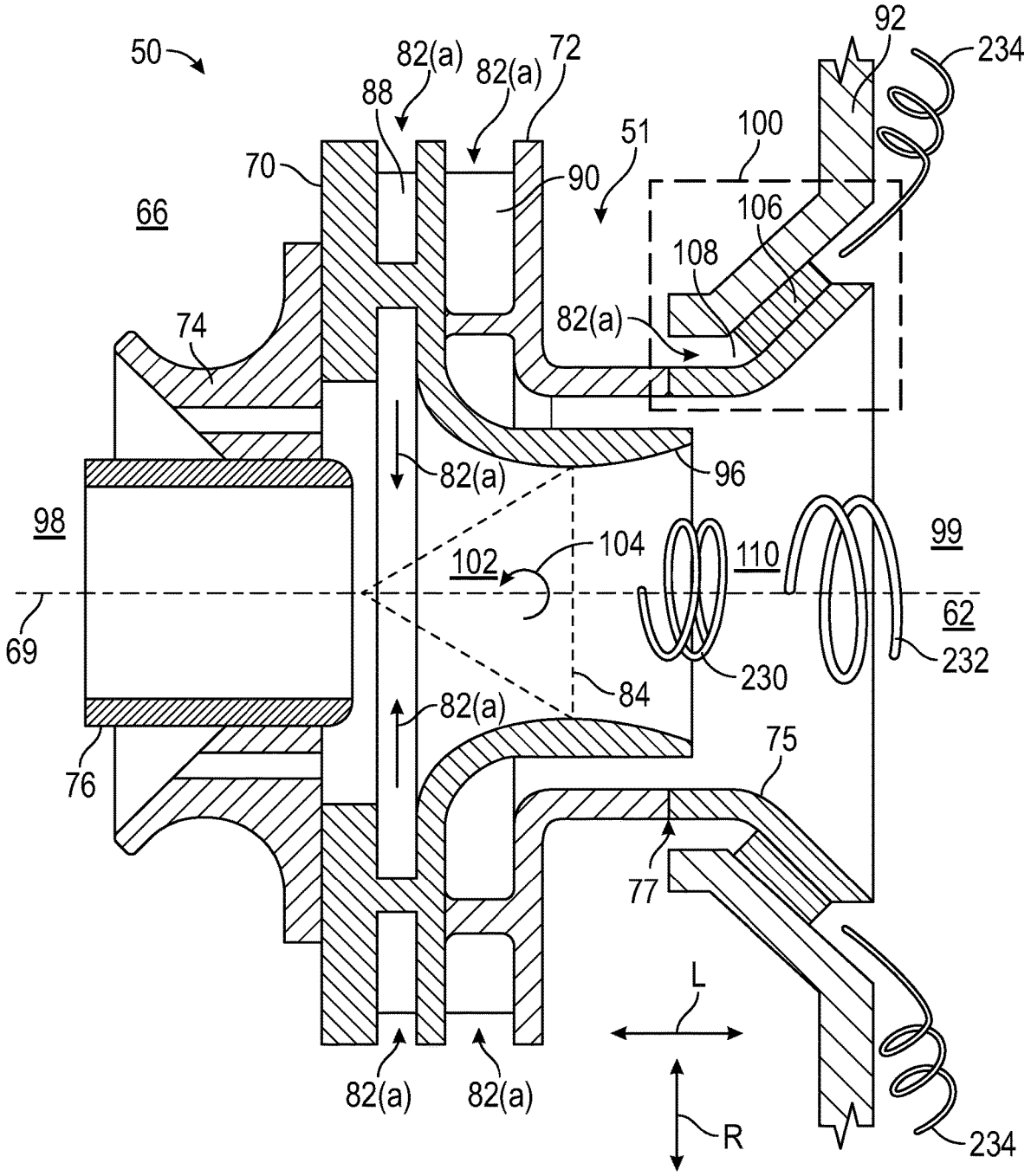
FIG. 3 is a partial cross-sectional side view of an exemplary swirler assembly, according to an aspect of the present disclosure.

FIG. 3 depicts a partial cross-sectional view of a forward portion of the swirler assembly 50. The swirler assembly 50 is generally symmetrical about a swirler assembly centerline 69, which extends in the longitudinal direction L and is generally perpendicular to the radial direction R. The swirler assembly 50 is suitably connected to the dome assembly 54, including via a support wall 94 (see FIG. 2) and a dome 92. The swirler assembly 50 includes a swirler 51 and a fuel nozzle 76 disposed within the swirler 51. The swirler 51 includes a primary swirler 70 that has a primary swirler venturi 96, a secondary swirler 72, and a swirler ferrule plate 74. The primary swirler 70 includes a plurality of primary swirler swirl vanes 88 that are circumferentially disposed in a row, such that each of the primary swirler swirl vanes 88 extends radially inward. The primary swirler 70 also includes the primary swirler venturi 96 that extends in the longitudinal direction L concentrically about the swirler assembly centerline 69. The primary swirler 70 is configured for swirling a corresponding portion of the compressed air 82(*a*) from the pressure plenum 66 radially inward in a primary swirl direction within the primary swirler 70 (i.e., either clockwise about the swirler assembly centerline 69, or counterclockwise about the swirler assembly centerline 69).

The secondary swirler 72 similarly includes secondary swirler swirl vanes 90 that are circumferentially disposed in a row such that each of the secondary swirler swirl vanes 90 extends radially inward. The secondary swirler 72 is configured for swirling another corresponding portion of the compressed air 82(*a*) from the pressure plenum 66 radially inward. The swirler 51 further includes a flare 75 connected to a downstream end 77 the secondary swirler 72.

The fuel nozzle 76, part of the fuel nozzle assembly 52 shown in FIG. 2, is disposed within the swirler ferrule plate 74 of the swirler 51. The fuel nozzle 76 injects a fuel 84 into the primary swirler venturi 96, where it is mixed with the portion of the compressed air 82(*a*) from the primary swirler 70 in a primary swirler venturi mixing region 102. The fuel and air mixture in the primary swirler venturi 96 further mixes downstream in a conical opening 110 of the flare 75 with the portion of the compressed air 82(*a*) from the secondary swirler 72. The fuel and air mixture from the flare 75 is then dispersed at a diverging angle from the flare 75 into the combustion chamber 62, where it is ignited and burned to generate the combustion product gases 86 within a primary combustion zone 87 of the combustion chamber 62.

As was mentioned above, the swirler assembly 50 includes the dome 92. As will be described in more detail below, a flare oxidizer flow passage 108 is defined between the flare and the dome 92, and a swirl inducing member 106 is disposed within the flare oxidizer flow passage 108. In operation, the portion of the compressed air 82(*a*) within the pressure plenum 66 flows through the flare oxidizer flow passage 108 as a cooling airflow, where a swirl is induced in the cooling airflow by the swirl inducing member 106. The swirled cooling airflow exiting the flare oxidizer flow passage 108 into the combustion chamber 62 remains closer to the dome plane and creates high turbulence in the primary combustion zone 87 of the combustion chamber 62, thereby providing for better mixing of the cooling air with the fuel-air mixture exiting the flare 75. This swirling air creates high flame strains in the primary zone of the combustor that reduces regions of the peak temperature closer to the flame, thereby reducing NOx emissions. Various arrangements of the swirl inducing member 106 within the flare oxidizer flow passage 108 will now be described in detail with reference to detail view 100 in FIG. 3.

Figure 4:
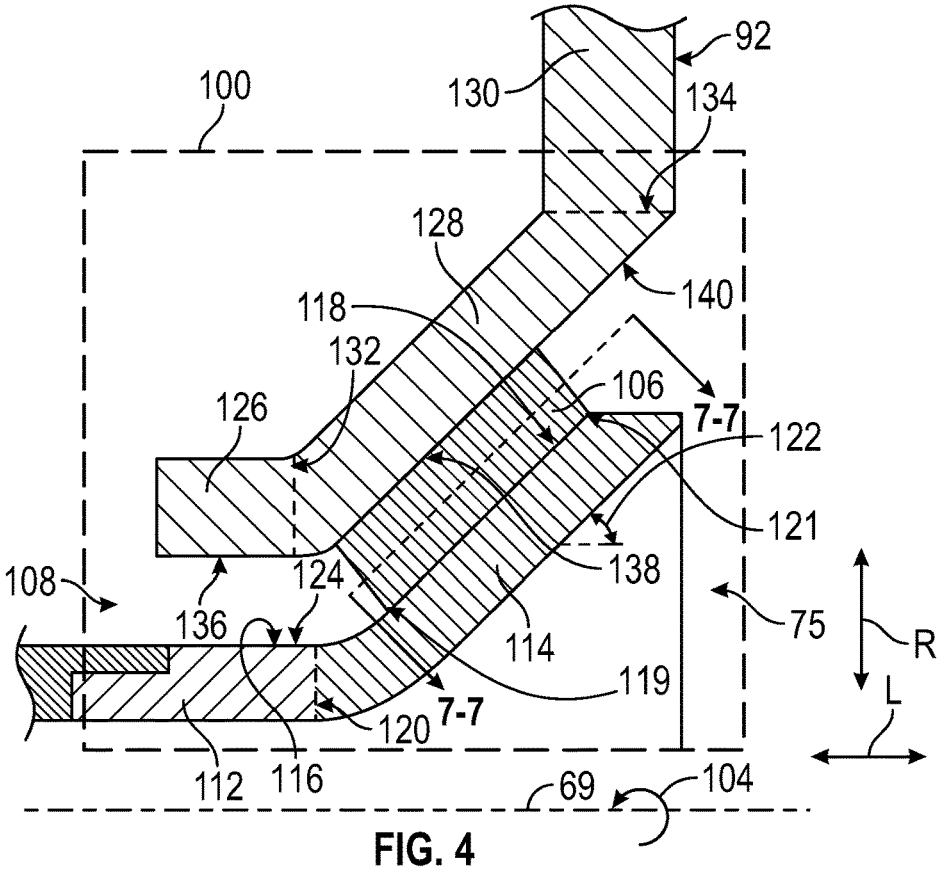
FIG. 4 depicts an exemplary flare oxidizer flow passage and swirler arrangement taken at detail view 100 of FIG. 3, according to an aspect of the present disclosure.

FIG. 4 depicts an exemplary flare oxidizer flow passage and swirler arrangement taken at detail view 100 of FIG. 3, according to an aspect of the present disclosure. In FIG. 4, the flare oxidizer flow passage and swirler arrangement is seen to include the flare 75, the dome 92, the flare oxidizer flow passage 108, and the swirl inducing member 106. The flare 75 includes a flare axial wall 112 and a flare conical wall 114. The flare axial wall 112 is an annular wall that extends in the longitudinal direction with respect to the swirler assembly centerline 69, and extends in a circumferential direction 104 about the swirler assembly centerline 69. The flare conical wall 114 is also an annular wall that is connected to the flare axial wall 112 at a downstream end 120 of the flare axial wall 112. The flare conical wall 114 extends circumferentially about the swirler assembly centerline 69, and extends radially outward and longitudinally downstream from the downstream end 120 of the flare axial wall 112. A flare angle 122 of the flare conical wall 114 may be, for example, forty-five degrees, or may range from thirty degrees to sixty degrees, with respect to the swirler assembly centerline 69. Of course, the flare angle 122 is not limited to the foregoing range, and other flare angles may be implemented instead. The flare axial wall 112 includes a flare axial wall outer surface 116, and the flare conical wall 114 includes a flare conical wall outer surface 118. Together, the flare axial wall outer surface 116 and the flare conical wall outer surface 118 may be referred to as a flare outer surface 124.

The dome 92 is seen to include a dome axial wall 126, a dome conical wall 128, and a dome radial wall 130. The dome axial wall 126 is an annular wall that extends in the longitudinal direction with respect to the swirler assembly centerline 69, and extends in the circumferential direction 104 about the swirler assembly centerline 69. The dome conical wall 128 is also an annular wall that extends circumferentially about the swirler assembly centerline 69. The dome conical wall 128 is connected to the dome axial wall 126 at a downstream end 132 of the dome axial wall 126, and extends radially outward and longitudinally downstream from the downstream end 132 of the dome axial wall 126. The dome radial wall 130 is connected to the dome conical wall 128 at a dome conical wall downstream end 134 of the dome conical wall 128. The dome radial wall 130 generally extends radially outward from the dome conical wall downstream end 134, and generally extends circumferentially about the swirler assembly centerline 69. While not depicted in the figures, the dome radial wall 130 may also extend at an angle radially outward and downstream from the dome conical wall downstream end 134.

The dome axial wall 126 includes a dome axial wall inner surface 136, while the dome conical wall 128 includes a dome conical wall inner surface 138. Together, the dome axial wall inner surface 136 and the dome conical wall inner surface 138 form a dome inner surface 140. The dome inner surface 140 and the flare outer surface 124 are spaced apart from one another via the swirl inducing member 106, so as to form the flare oxidizer flow passage 108 therebetween.

Figure 5:
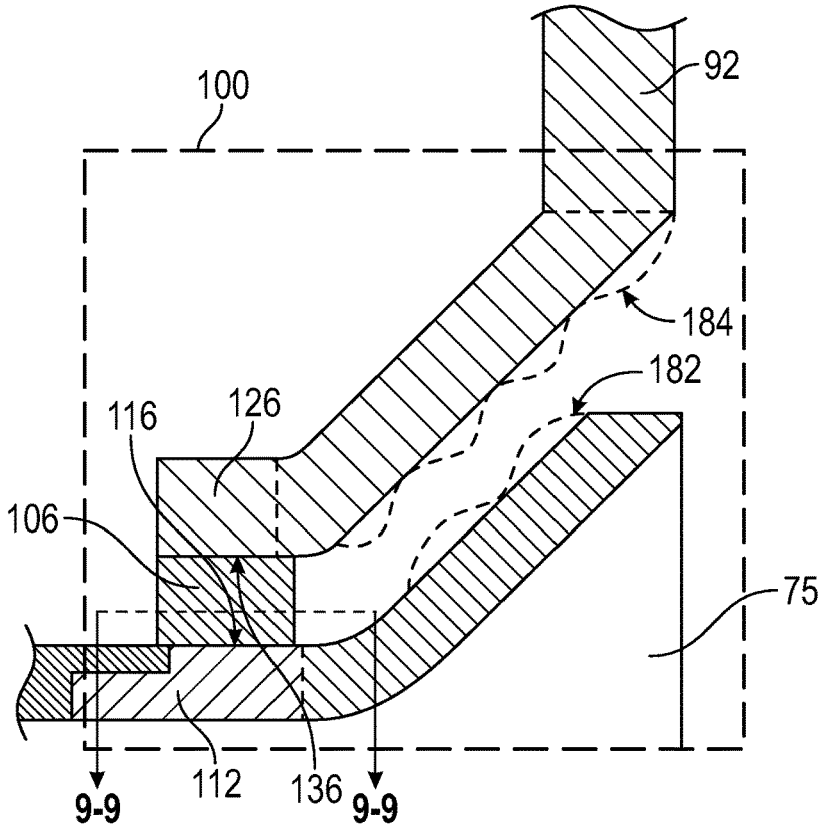
FIG. 5 depicts another exemplary flare oxidizer flow passage and swirler arrangement taken at detail view 100 of FIG. 3, according to another aspect of the present disclosure.

In FIG. 4, the swirl inducing member 106 is shown as being disposed between the dome conical wall inner surface 138 and the flare conical wall outer surface 118. However, as seen in FIG. 5, the swirl inducing member 106 may be arranged between the dome axial wall inner surface 136 and the flare axial wall outer surface 116. With the arrangement shown in FIG. 5, the flare conical wall 114 may optionally include flare conical wall corrugations 182. The flare conical wall corrugations 182 may help to improve the turbulence of the flow of oxidizer through the flare oxidizer flow passage 108. In addition, the dome conical wall 128, like the flare conical wall 114, may optionally include dome conical wall corrugations 184. The dome conical wall corrugations 184 may also help to improve the turbulence of the flow of oxidizer through the flare oxidizer flow passage 108. Of course, although not shown in the figures, corrugations similar to the flare conical wall corrugations 182 may be provided to extend radially outward from the flare axial wall 112 into the flare oxidizer flow passage 108, and may be included as part of the swirl inducing member 106. Similarly, corrugations similar to the dome conical wall corrugations 184 may be provided to extend radially inward from the dome axial wall 126 into the flare oxidizer flow passage 108, and may be included as part of the swirl inducing member 106.

Figure 6:
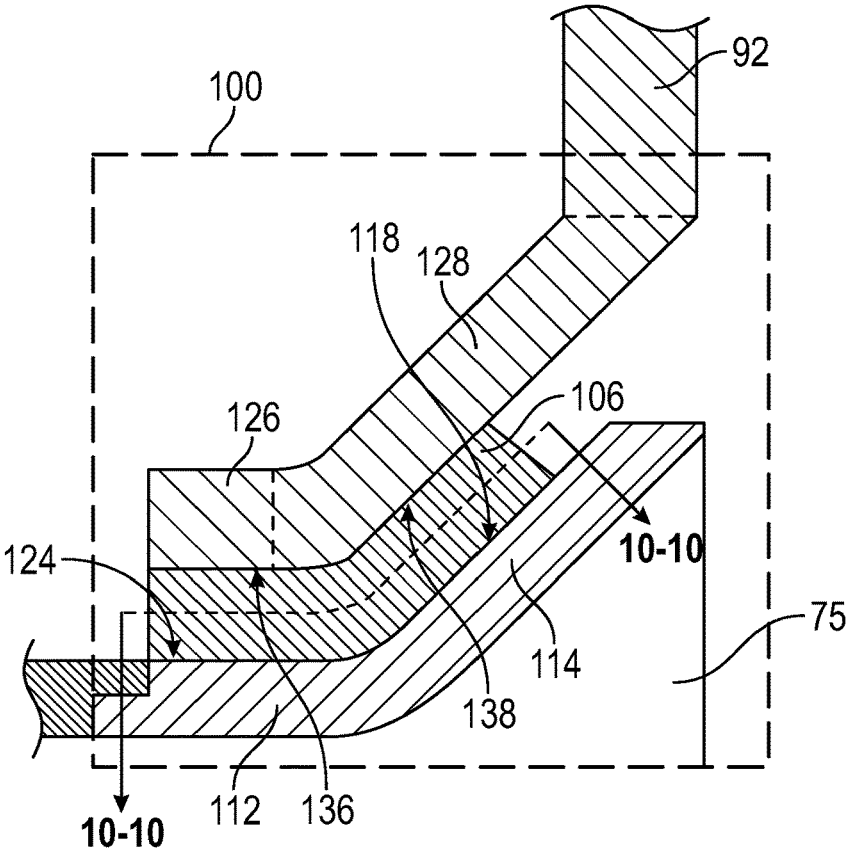
FIG. 6 depicts yet an exemplary flare oxidizer flow passage and swirler arrangement taken at detail view 100 of FIG. 3, according to yet another aspect of the present disclosure.

Alternatively, as shown in FIG. 6, the swirl inducing member 106 may disposed between the dome axial wall inner surface 136 and the flare axial wall outer surface 116 and extend downstream within the flare oxidizer flow passage 108 so as to also be disposed between the dome conical wall inner surface 138 and the flare conical wall outer surface 118. This arrangement may also include the flare conical wall corrugations 182 and the dome conical wall corrugations 184, along with the (not shown) corrugations on the flare axial wall 112 and/or the dome axial wall 126.

Figure 7:
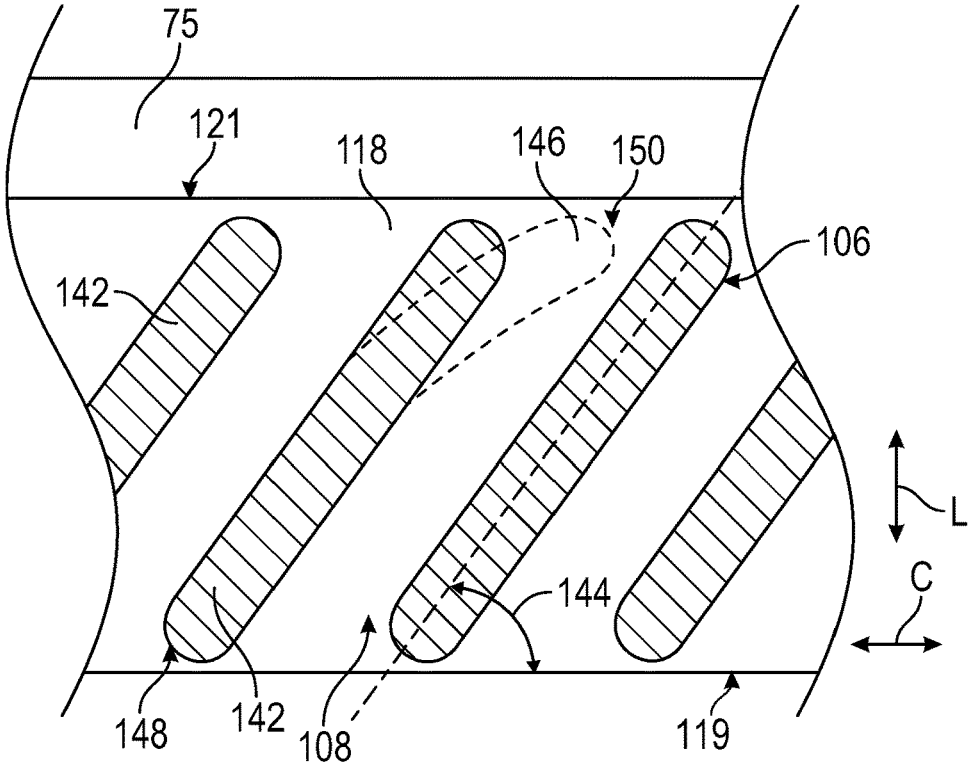
FIG. 7 is a partial cross-sectional view through the flare oxidizer flow passage 108, including the swirl inducing member 106, taken at plane 7-7 of FIG. 4.

Various arrangements of the swirl inducing member 106 will now be described with regard to FIGS. 7 to 10. FIG. 7 is a partial cross-sectional view through the flare oxidizer flow passage 108, including the swirl inducing member 106, taken at plane 7-7 of FIG. 4. In the arrangement of FIG. 7, the swirl inducing member 106 is implemented as a plurality of swirl vanes 142 that are circumferentially spaced apart from one another about the circumference of the flare conical wall 114 such that the flare oxidizer flow passage 108 is defined between successive pairs of the plurality of swirl vanes 142. As is commonly known in the art, a swirl vane may generally be a relatively thin wall that extends between two surfaces, and arranged at an angle or having a particular shape to impart a change of direction in a flow of air passing over the surface of the swirl vane. Thus, the swirl vanes 142, in the FIG. 4 aspect, may be such a thin wall extending between the flare conical wall outer surface 118 and the dome conical wall inner surface 138.

The swirl vanes 142 are seen to extend from an upstream end 119 (see also FIG. 4) of the flare conical wall 118 to a downstream end 121 (see also FIG. 4) of the flare conical wall 118. The swirl vanes 142 are also seen to be arranged at a swirl vane angle 144 with respect to the longitudinal direction along the swirler assembly centerline 69 (FIG. 4). The swirl vane angle 144 may be set so as to provide a desired swirl number to the airflow exiting the flare oxidizer flow passage 108 into the combustion chamber 62 (FIG. 3). As will be described in more detail below, the swirl vane angle 144 need not be the same for all of the swirl vanes 142, but can be different about the circumference of the flare 75. In the FIG. 7 aspect, the swirl vanes 142 are also generally shown to be axial vanes (i.e., straight along their length), but as seen in an alternate aspect, may constitute a curved swirl vane 146 instead. The curved swirl vane 146 may have a continuous curvature along its length, or it may have a sharper curve toward an outlet end 150 of the curved swirl vane 146 than at an inlet end 148 of the curved swirl vane 146.

Figure 8:
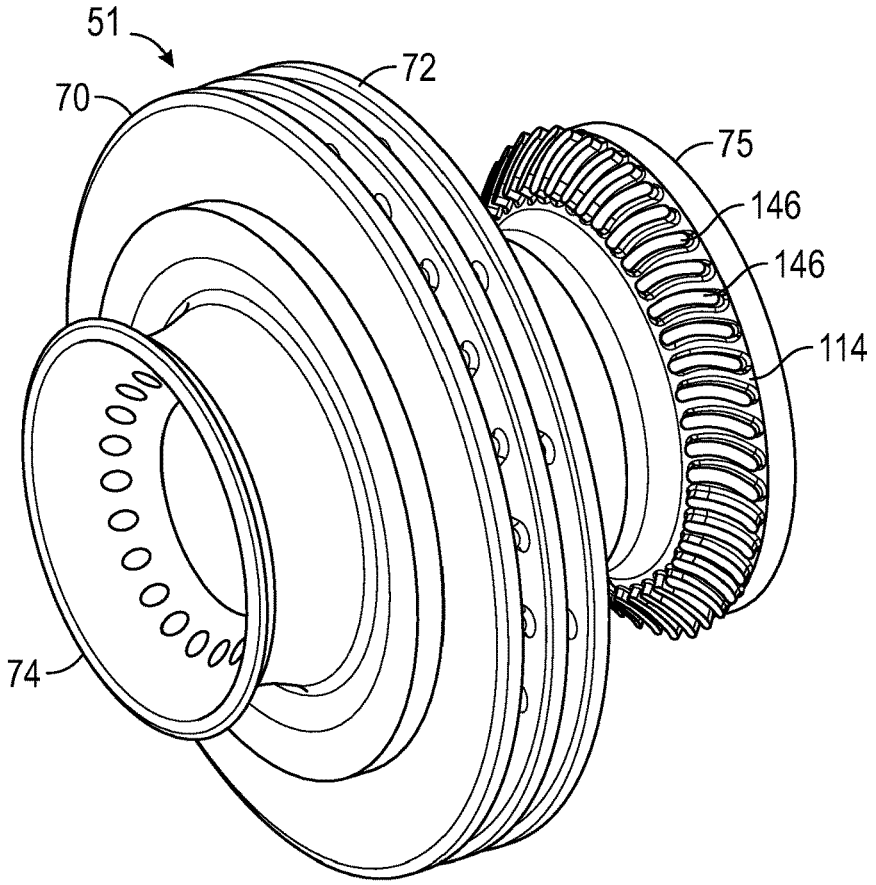
FIG. 8 is an aft-looking perspective view of an exemplary swirler assembly, with the dome removed, according to an aspect of the present disclosure.

FIG. 8 is an aft-looking perspective view of an exemplary swirler 51, with the dome 92 (FIG. 4) removed so as to show an example of the plurality of curved swirl vanes 146 arranged about the circumference of the flare conical wall 114. As yet another example, in FIG. 7, the swirl vane 142 may instead be a curved swirl vane 146 that has a curved swirl vane outlet end 150 and may include an axial portion at the inlet end 148, where the curved swirl vane outlet end commences mid-length of the curved swirl vane 146 such that the outlet end 150 is curved to impart a higher swirl number in the flow of the air exiting the flare oxidizer flow passage 108.

Figure 9:
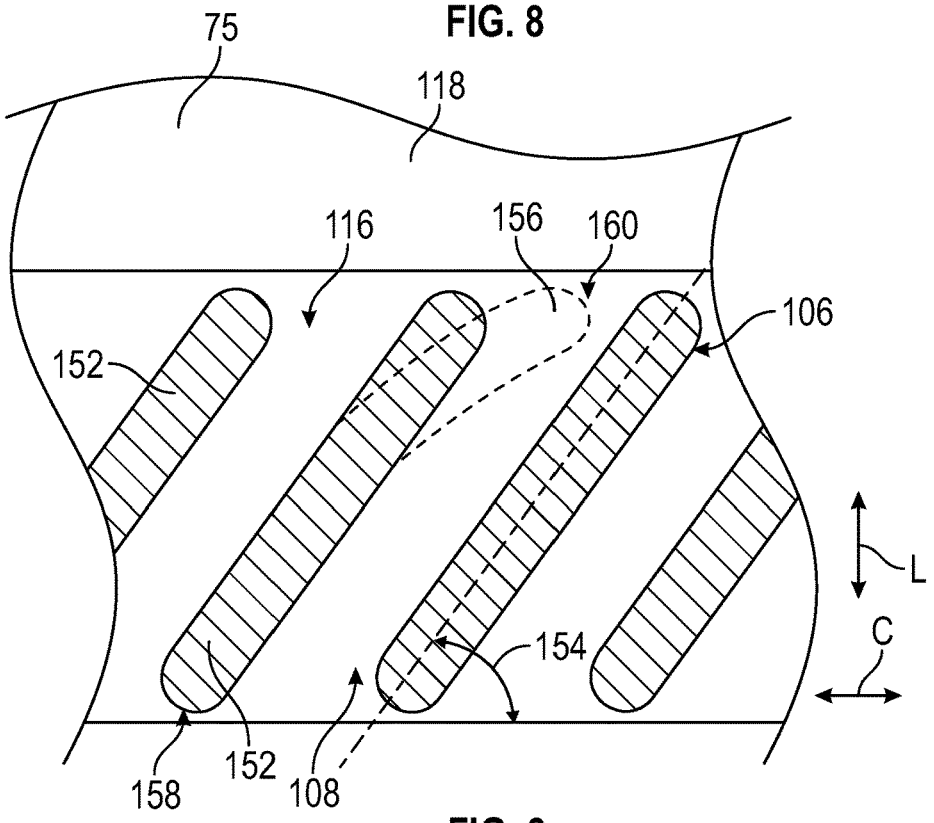
FIG. 9 is a partial cross-sectional view through the flare oxidizer flow passage 108, including the swirl inducing member 106, taken at plane 9-9 of FIG. 5.

FIG. 9 depicts a partial cross-sectional view of the swirl inducing member 106 and the flare oxidizer flow passage 108 taken at plane 9-9 in FIG. 5. In FIG. 5, the swirl inducing member 106 is shown disposed between the flare axial wall outer surface 116 and the dome axial wall inner surface 136. In FIG. 9, similar to FIG. 7, a plurality of swirl vanes 152 are seen to implement the swirl inducing member 106. The swirl vanes 152 may be similar to the swirl vanes 142 (FIG. 7) in that they may be axial and arranged at a swirl angle 154, or may be implemented as a curved swirl vane 156 that induces a higher swirl number at an outlet end 160 of the swirl vanes 152 than at an inlet end 158 of the swirl vanes 152.

Figure 10:
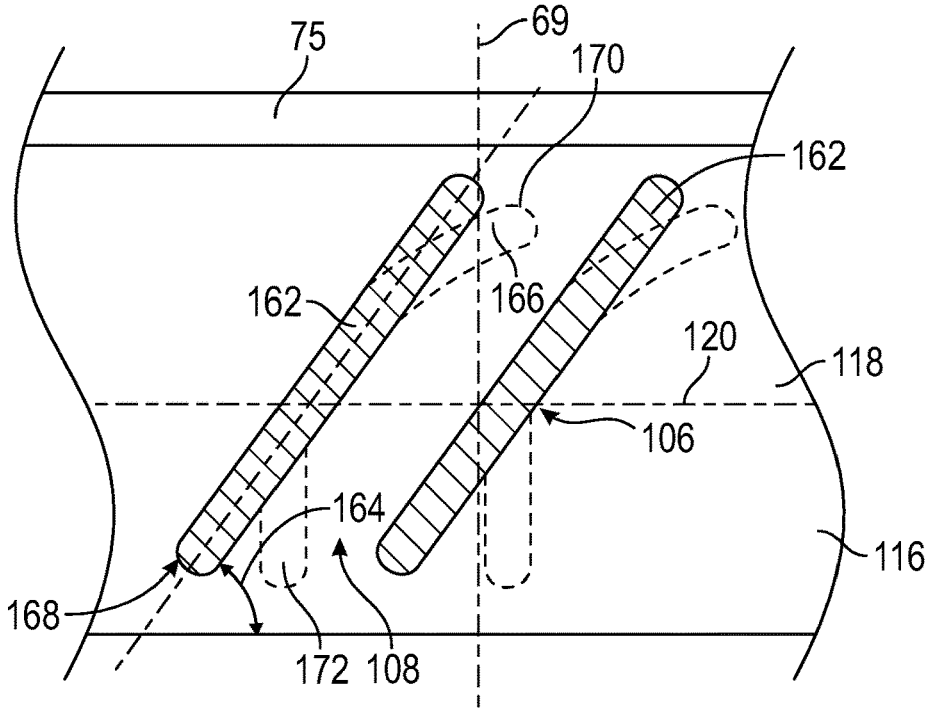
FIG. 10 is a partial cross-sectional view through the flare oxidizer flow passage 108, including the swirl inducing member 106, taken at cutline 10-10 of FIG. 6.

FIG. 10 depicts a partial cross-sectional view of the swirl inducing member 106 taken at cutline 10-10 in FIG. 6. In FIG. 6, the swirl inducing member 106 is shown disposed between the flare outer surface 124 and the dome inner surface 140. In FIG. 10, similar to FIGS. 7 and 9, a plurality of swirl vanes 162 are seen to implement the swirl inducing member 106. The swirl vanes 162 may be similar to the swirl vanes 142 (FIG. 7) and the swirl vanes 152 (FIG. 9) in that they may be axial and arranged at a swirl angle 164, or may be implemented as a curved swirl vane 166 that induces a higher swirl number at an outlet end 170 of the swirl vanes 162 than at an inlet end 168 of the swirl vanes 162. As another alternative shown in FIG. 10, either the swirl vane 162 or the curved swirl vane 166 may include an axial inlet portion 172, that may be generally axially aligned with the swirler assembly centerline 69, rather than being arranged at the swirl angle 164.

Figure 11:
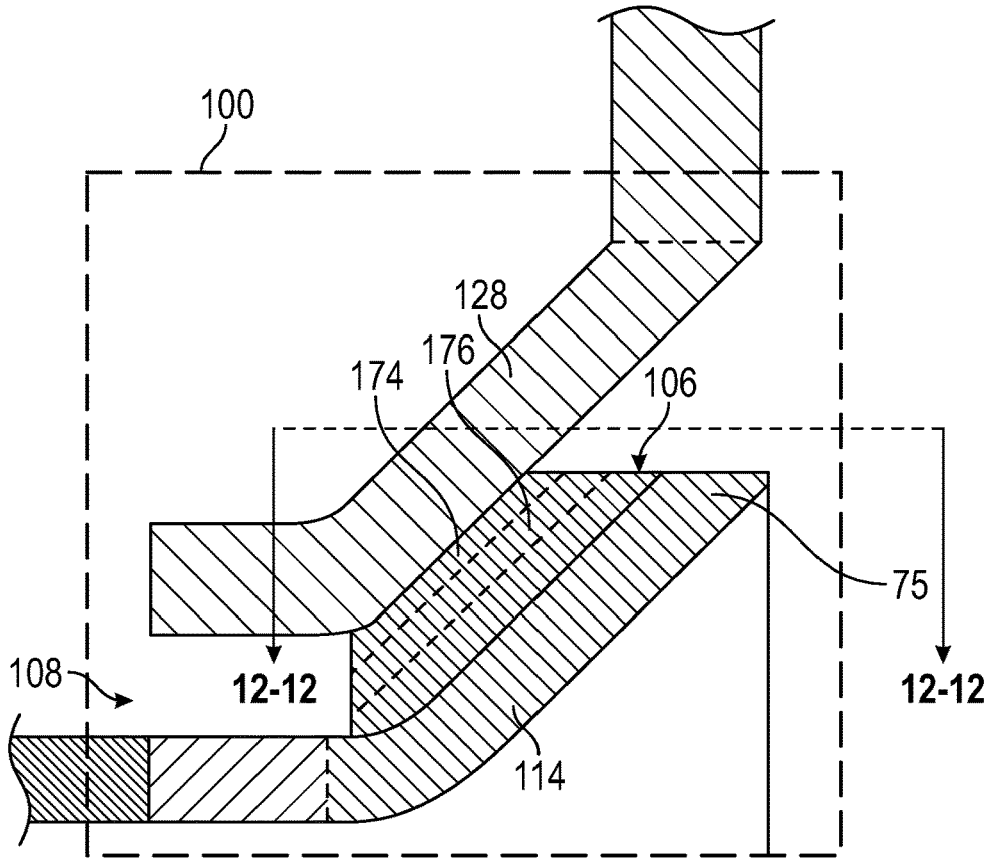
FIG. 11 depicts still another exemplary flare oxidizer flow passage and swirler arrangement taken at detail view 100 of FIG. 3, according to yet another aspect of the present disclosure.
Figure 12:
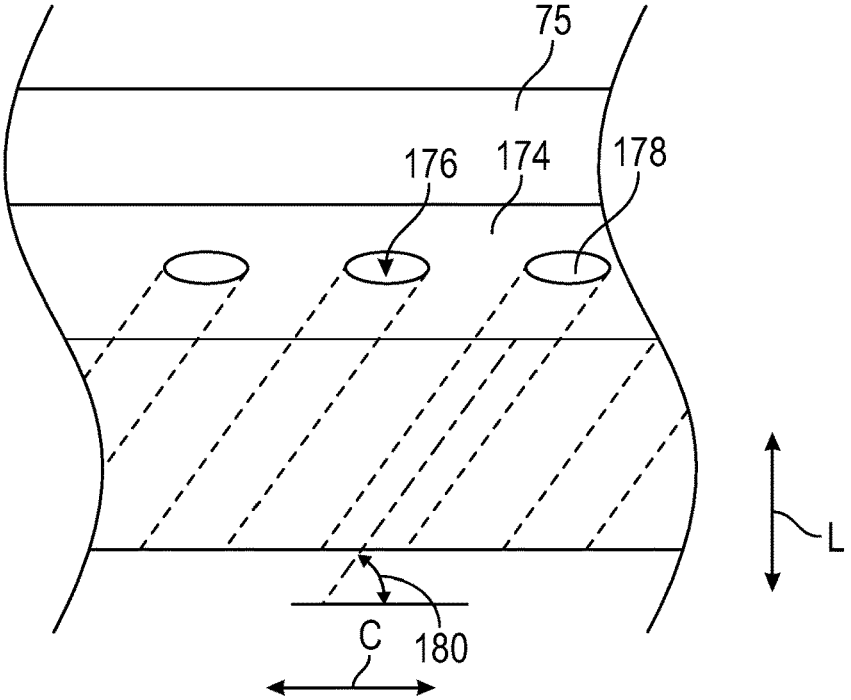
FIG. 12 is a partial cross-sectional view through the flare oxidizer flow passage 108, including the swirl inducing member 106, taken at plane 12-12 of FIG. 11.

In FIGS. 7 to 10, the swirl inducing member 106 was described as being implemented by a plurality of swirl vanes. The swirl inducing member 106 is not limited to swirl vanes, however, and FIGS. 11 and 12 depict another implementation of the swirl inducing member 106. In FIGS. 11 and 12, the swirl inducing member 106 is implemented as an annular ring 174 having a plurality of orifices 176 therethrough. Each of the plurality of orifices 176 may be arranged at an angle 180 with respect to the circumferential direction, such that an outlet end 178 of each of the orifices 176 provides a tangential flow of the oxidizer therethrough into the combustion chamber 62. The angle 180, like the swirl vane angle 144 of the swirl vanes 142 (FIG. 7) may be set so as to provide a desired swirl number in the flow of oxidizer into the combustion chamber 62 (FIG. 2). In addition, the number of orifices 176, the size of the orifices 176, and the circumferential spacing of the orifices 176 may all be set to provide a desired amount of flow of the oxidizer therethrough and a desired swirl number of the flow of oxidizer into the combustion chamber 62.

Figure 13:
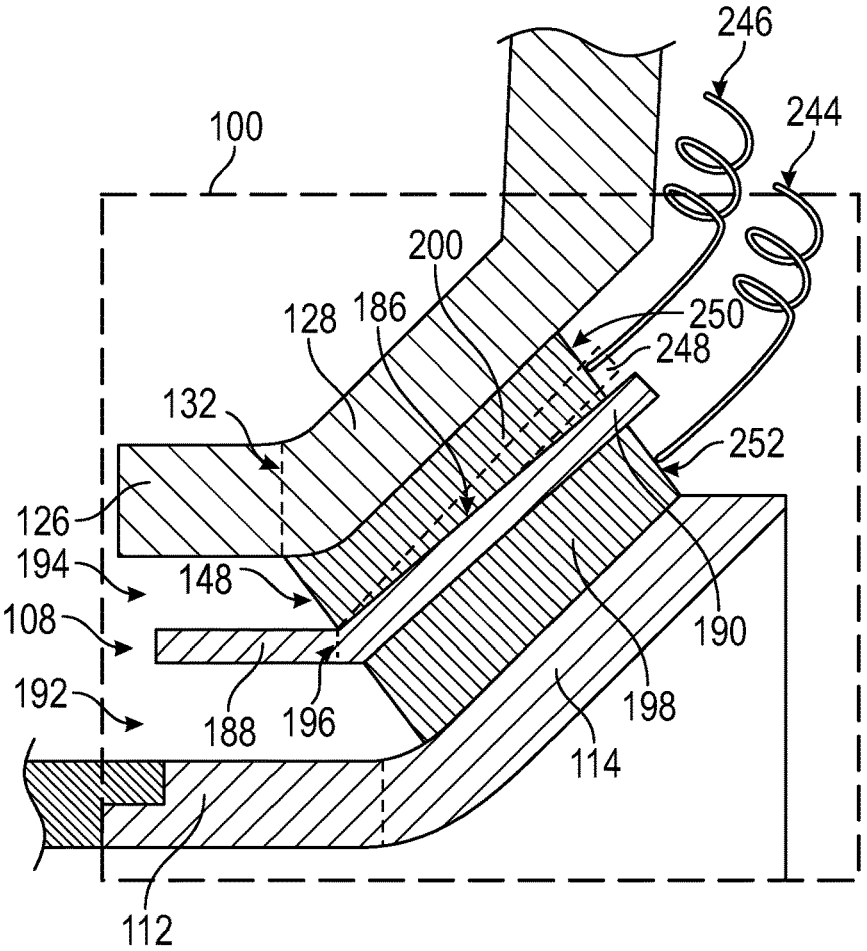
FIG. 13 depicts yet another exemplary flare oxidizer flow passage and swirler arrangement taken at detail view 100 of FIG. 3, according to still aspect of the present disclosure.

FIG. 13 depicts another exemplary flare oxidizer flow passage and swirler arrangement taken at detail view 100 of FIG. 3, according to another aspect of the present disclosure. In FIG. 13, an intermediate wall 186 is included within the flare oxidizer flow passage 108, so as to divide the flare oxidizer flow passage 108 into a flare-side oxidizer flow passage 192 and a dome-side oxidizer flow passage 194. The intermediate wall 186 is defined by an intermediate axial wall 188 and an intermediate conical wall 190. The intermediate axial wall 188 may be generally evenly spaced between the dome axial wall 126 and the flare axial wall 112, and the intermediate conical wall 190 may also be generally evenly spaced between the dome conical wall 128 and the flare conical wall 114. When this arrangement is implemented, the flare-side oxidizer flow passage 192 and the dome-side oxidizer flow passage 194 may generally be about the same height throughout the length of the passage. However, the intermediate wall 186 may be offset closer to the dome 92 (FIG. 2), such that the flare-side oxidizer flow passage 192 has a greater height than that of the dome-side oxidizer flow passage 194. Alternatively, the intermediate wall 186 may be offset closer to the flare 75 (FIG. 2), such that the flare-side oxidizer flow passage 192 has a smaller height than the dome-side oxidizer flow passage 194. Additionally, the intermediate conical wall 190 may not be evenly spaced between the flare conical wall 114 and the dome conical wall 128, but may instead be arranged unevenly so as to form an intermediate conical wall 248. When this arrangement is implemented, a dome-side oxidizer flow passage outlet end 250 of the dome-side oxidizer flow passage 194 may form a converging outlet, while a flare-side oxidizer flow passage outlet end 252 of the flare-side oxidizer flow passage 192 may form a diverging outlet.

In FIG. 13, with the inclusion of two oxidizer flow passages, a flare-side swirl inducing member 198 is provided within the flare-side oxidizer flow passage 192, and a dome-side swirl inducing member 200 is provided within the dome-side oxidizer flow passage 194. Both the flare-side swirl inducing member 198 and the dome-side swirl inducing member 200 may be implemented as any of the swirl inducing member configurations described above with regard to FIGS. 4 to 12. That is, as one example, both the flare-side swirl inducing member 198 and the dome-side swirl inducing member 200 may be the same as the swirl inducing member 106 of FIG. 4, and include either the swirl vanes 142 or the curved swirl vanes 146 of FIG. 7. The dome-side swirl inducing member 200 may, however, at the curved swirl vane inlet end 148, extend between the dome axial wall downstream end 132 and an intermediate axial wall downstream end 196. Accordingly, the foregoing descriptions of those implementations will not be repeated herein.

In the FIG. 13 aspect, however, the flare-side swirl inducing member 198 and the dome-side swirl inducing member 200 may also be different from one another. As one example, the flare-side swirl inducing member 198 may implement the FIG. 4 aspect of the swirl inducing member 106, and include the swirl vanes 142 of FIG. 7, while the dome-side swirl inducing member 200 may implement the FIG. 5 aspect of the swirl inducing member 106, and include the swirl vanes 152 of FIG. 9. In addition, the flare-side swirl inducing member 198 and the dome-side swirl inducing member 200 may be arranged to swirl the flow of oxidizer therethrough in opposite swirl directions. For instance, the flare-side swirl inducing member 198 may be arranged to provide a clockwise swirl of the oxidizer about the swirler assembly centerline 69, while the dome-side swirl inducing member 200 may be arranged to provide a counterclockwise swirl of the oxidizer therethrough about the swirler assembly centerline 69 (FIG. 2). The flare-side swirl inducing member 198 may also be arranged to provide the flare-side swirled flow of oxidizer 244 either in the same direction as that of a swirled secondary fuel-oxidizer mixture 232, or in the opposite direction of the swirled secondary fuel-oxidizer mixture 232.

Figure 14:
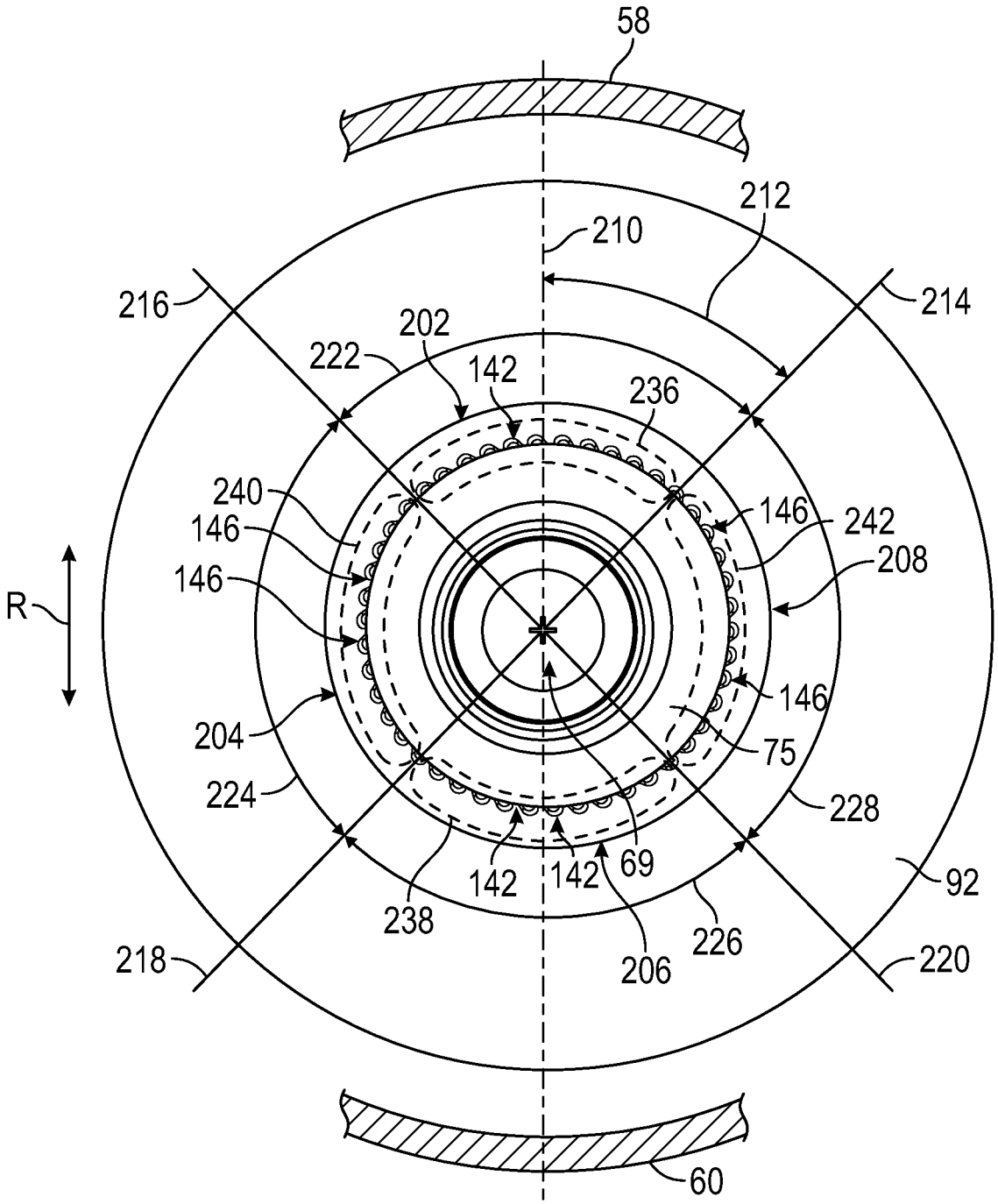
FIG. 14 is partial cross-sectional aft forward-looking view taken at plane 14-14 shown in FIG. 2.

FIG. 14 is partial cross-sectional aft forward-looking view taken at plane 14-14 shown in FIG. 2. With regard to FIG. 14, a description will be given regarding an implementation of a combination of swirl vanes 142 and curved swirl vanes 146 being disposed about the circumference of the flare 75 in an alternating arrangement. In FIG. 14, a radial reference line 210 is seen to extend in the radial direction R through the swirler assembly centerline 69. A first quadrant beginning reference line 214 is seen to be angularly offset by an angle 212 (e.g., forty five degrees) in the clockwise direction from the radial reference line 210. A first quadrant 202 about the circumference of the flare 75 is defined in the counterclockwise direction about the swirler assembly centerline 69 between first quadrant beginning reference line 214 and a first quadrant ending reference line 216. The first quadrant 202 is seen to be on an outer liner side (i.e., nearest the outer liner 58) of the flare 75. A first quadrant angle 222 of the first quadrant 202 may be, for example, ninety degrees. A second quadrant 204 is defined in the counterclockwise direction from the first quadrant ending reference line 216 to a second quadrant ending reference line 218, and a second quadrant angle 224 of the second quadrant 204 may be, for example, ninety degrees. A third quadrant 206 is defined in the counterclockwise direction from the second quadrant ending reference line 218 to a third quadrant ending reference line 220, and a third quadrant angle 226 may also be, for example, ninety degrees. The third quadrant 206 is seen to be arranged on an inner liner side (i.e., nearest the inner liner 60) of the flare 75. A fourth quadrant 208 is defined in the counterclockwise direction from the third quadrant ending reference line 220 to the first quadrant beginning reference line 214, and a fourth quadrant angle 228 of the fourth quadrant 208 may be, for example, ninety degrees.

About the circumference of the flare 75, when swirl vanes such as the swirl vanes 142 and the curved swirl vanes 146 are implemented as the swirl inducing member 106, the swirl vanes may be circumferentially arranged so as to include different groups of swirl vanes within each of the first quadrant 202, the second quadrant 204, the third quadrant 206, and the fourth quadrant 208. For example, a first group 236 of swirl vanes 142 may be implemented circumferentially within the first quadrant 202, while a second group 238 of the swirl vanes 142 may be implemented in the third quadrant 206 opposing the first group 236 of swirl vanes 142 in the first quadrant 202. On the other hand, a third group 240 of curved swirl vanes 146 may be implemented circumferentially within the second quadrant 204, while a fourth group 242 of the curved swirl vanes 146 may be implemented in the fourth quadrant 208 opposing the third group 240 of curved swirl vanes 146 in the second quadrant 204. The implementation of the swirl vanes 142 in the first quadrant 202 and the third quadrant 206 provide for swirl vanes having a lower swirl number being arranged nearest the outer liner 58 and the inner liner 60. On the other hand, the implementation of the curved swirl vanes 146 in the second quadrant 204 and the fourth quadrant 208 provide for a higher swirl number as compared with the swirl vanes 142 in the first quadrant 202 and the third quadrant 206. Thus, the higher swirl number induced by the curved swirl vanes 146 in the second quadrant 204 and the fourth quadrant 208 help to keep a swirled flare oxidizer flow 234 (FIG. 3) circumferentially closer to the swirler assembly centerline 69. As a result, for example, as the higher swirl number oxidizer flows counterclockwise from the fourth quadrant 208 through the first quadrant 202, the higher swirled oxidizer flow does not impinge as heavily upon the outer liner 58, thereby reducing the scrubbing of the flame on the outer liner 58 and improving the durability of the outer liner 58. The same applies to the higher swirl number for the curved swirl vanes 146 implemented within the second quadrant 204 as the higher swirled oxidizer flows through the third quadrant 206 and may impinge on the inner liner 60.

Figure 15:
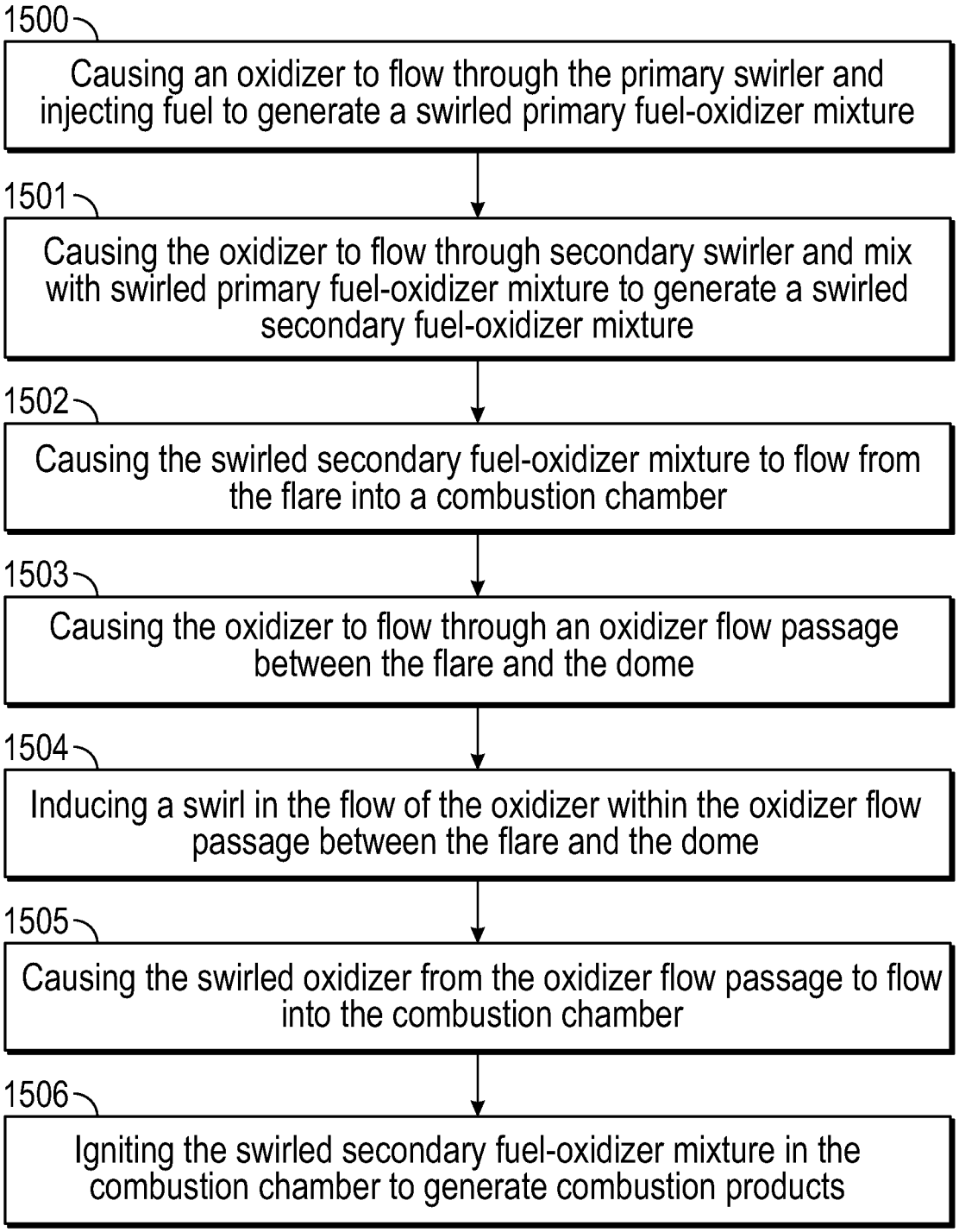
FIG. 15 is a flowchart of an exemplary method of operating a combustor, according to an aspect of the present disclosure.

FIG. 15 is a flow chart depicting process steps for a method of operating a combustor of a gas turbine, according to an aspect of the present disclosure. The method of FIG. 15 may be seen to comprise operating the combustion section 26 (also referred to as a combustor) of the gas turbine engine 10. Thus, for the method, the combustion section 26 includes the swirler assembly 50 having: the swirler 51, with the primary swirler 70, the secondary swirler 72, and the flare 75 connected to the secondary swirler 72; the dome 92 disposed radially outward of the flare 75; and the flare oxidizer flow passage 108 arranged circumferentially between the flare 75 and the dome 92. Further, the swirl inducing member 106 is disposed within the flare oxidizer flow passage 108. The combustion section 26 further includes the outer liner 58 and the inner liner 60, where the outer liner 58 and the inner liner 60 define the combustion chamber 62 therebetween. The fuel nozzle 76 is also disposed in the swirler 51.

In the method of FIG. 15, a first step 1500 provides for causing an oxidizer (e.g., portion of compressed air 82(*a*)) to flow through the primary swirler 70 and injecting the fuel 84 from the fuel nozzle 76 into the primary swirler 70 to generate a swirled primary fuel-oxidizer mixture 230 (FIG. 3). A second step 1501 in the method provides for causing the oxidizer (e.g., portion of compressed air 82(*a*)) to flow through the secondary swirler 72 and mixing the swirled oxidizer from the secondary swirler 72 with the swirled primary fuel-oxidizer mixture 230 to generate a swirled secondary fuel-oxidizer mixture 232 (FIG. 3). A third step 1502 comprises causing the swirled secondary fuel-oxidizer mixture 232 to flow from the flare 75 into the combustion chamber 62.

Step 1503 of the method includes causing the oxidizer (e.g., portion of compressed air 82(*a*)) to flow through the flare oxidizer flow passage 108 between the flare 75 and the dome 92, and a step 1504 comprises inducing, by the swirl inducing member 106, a swirl into the flow of the oxidizer flowing through the flare oxidizer flow passage 108 to generate a swirled flare oxidizer flow 234 (FIG. 3) that flows from the flare oxidizer flow passage 108 into the combustion chamber 62 (step 1505). A step 1506 then comprises igniting the secondary fuel-oxidizer mixture in the combustion chamber 62 to generate combustion product gases.

In the inducing, step 1504, the method may be further implemented via the plurality of swirl vanes 142 and the plurality of curved swirl vanes 146 arranged circumferentially within the flare oxidizer flow passage 108. In this arrangement, the inducing of the swirled flow of the oxidizer through the oxidizer flow passage includes inducing, by a first group 236 of the swirl vanes 142 among the plurality of swirl vanes, and a second group 238 of the swirl vanes 142 circumferentially opposing the first group 236 of swirl vanes 142, a first swirled flow of the oxidizer with a first swirl number, and inducing, by a third group 240 of curved swirl vanes 146 among the plurality of swirl vanes, and a fourth group 242 of curved swirl vanes 146 circumferentially opposing the third group 249 of curved swirl vanes 146, a second swirled flow of the oxidizer with a second swirl number higher than the first swirl number. The third group 240 of curved swirl vanes 146 is circumferentially arranged between the first group 236 of swirl vanes 142 and the second group 238 of swirl vanes 142, and the fourth group 242 of curved swirl vanes 146 is arranged circumferentially opposed to the third group 240 of curved swirl vanes 146 and is arranged between the first group 236 of swirl vanes 142 and the second group 238 of the swirl vanes 142. The first group 236 of swirl vanes 142 is disposed in a first quadrant 202 adjacent to the outer liner 58, and in a third quadrant 206 opposed to the first quadrant 202 and adjacent the inner liner 60. The third group 240 of curved swirl vanes 146 is disposed in a second quadrant 204 between the first quadrant 202 and the third quadrant 206, and in a fourth quadrant 208 opposing the second quadrant 204 and between the first quadrant 202 and the third quadrant 206.

In another aspect, the inducing step 1504 may be implemented by splitting the flare oxidizer flow passage 108 into multiple flow passages. The flare oxidizer flow passage 108 includes an intermediate wall 186 provided between the flare 75 and the dome 92, the intermediate wall 186 defining a flare-side oxidizer flow passage 192 between the flare 75 and the intermediate wall 186, and a dome-side oxidizer flow passage 194 provided between the dome 92 and the intermediate wall 186. The flare-side oxidizer flow passage 192 includes a flare-side swirl inducing member 198, and the dome-side oxidizer flow passage 194 includes a dome-side swirl inducing member 200. In this arrangement, the inducing step 1504 comprises inducing a flare-side swirled flow of the oxidizer 244 by the flare-side swirl inducing member 198, and inducing a dome-side swirled flow of the oxidizer 246 by the dome-side swirl inducing member 200. The swirl direction of the flare-side swirled flow of the oxidizer 244 may be in a co-swirl direction with the swirl direction of the dome-side swirled flow of the oxidizer 246 (i.e., both are in the clockwise direction or both are in the counterclockwise direction), or the swirl direction of the flare-side swirled flow of the oxidizer 244 may be in a counter-swirl direction with the swirl direction of the dome-side swirled flow of the oxidizer 246 (i.e., one is in the clockwise direction and the other is in the counterclockwise direction).

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A swirler assembly for a gas turbine engine, the swirler assembly defining a swirler assembly centerline therethrough, a longitudinal direction along the swirler assembly centerline, a radial direction extending outward from the swirler assembly centerline, and a circumferential direction about the swirler assembly centerline, the swirler assembly comprising: a swirler having a primary swirler and a secondary swirler, the secondary swirler being disposed longitudinally downstream of the primary swirler along the swirler assembly centerline; a flare connected to a downstream end of the secondary swirler, the flare including (i) a flare axial wall extending circumferentially about the swirler assembly centerline and extending in the longitudinal direction, the flare axial wall having a flare axial wall outer surface, and (ii) a flare conical wall connected at a downstream end of the flare axial wall and extending circumferentially about the swirler assembly centerline, and extending radially outward and longitudinally downstream from the downstream end of the flare axial wall, the flare conical wall having a flare conical wall outer surface, wherein the flare axial wall outer surface and the flare conical wall outer surface define a flare outer surface; and a dome disposed radially outward of the flare, the dome including (i) a dome axial wall extending circumferentially about the swirler assembly centerline and extending in the longitudinal direction, the dome axial wall having a dome axial wall inner surface, (ii) a dome conical wall connected at a downstream end of the dome axial wall and extending circumferentially about the swirler assembly centerline, and extending radially outward and longitudinally downstream from the downstream end of the dome axial wall, and (iii) a dome radial wall extending radially outward from a downstream end of the dome conical wall, the dome conical wall having a dome conical wall inner surface, wherein the dome axial wall inner surface and the dome conical wall inner surface define a dome inner surface, wherein a flare oxidizer flow passage is defined by the flare outer surface and the dome inner surface, and wherein the flare oxidizer flow passage includes a swirl inducing member therewithin that induces a swirled flow of an oxidizer passing through the flare oxidizer flow passage into a combustion chamber.

The swirler assembly according to any preceding clause, wherein the swirl inducing member is arranged to induce the swirled flow in a co-swirl direction as a swirl direction of the secondary swirler.

The swirler assembly according to any preceding clause, wherein the swirl inducing member is arranged to induce the swirled flow in a counter-swirl direction as a swirl direction of the secondary swirler.

The swirler assembly according to any preceding clause, wherein the swirl inducing member comprises an annular ring having a plurality of orifices therethrough, wherein an outlet end of each of the plurality of orifices extends at least partially in the circumferential direction so as to provide a tangential flow of the oxidizer therethrough into a combustion chamber.

The swirler assembly according to any preceding clause, wherein at least a portion of the flare outer surface includes corrugations, and wherein at least a portion of the dome inner surface comprises corrugations.

The swirler assembly according to any preceding clause, wherein the swirl inducing member comprises a plurality of swirl vanes.

The swirler assembly according to any preceding clause, wherein the plurality of swirl vanes are arranged between the flare conical wall outer surface and the dome conical wall inner surface.

The swirler assembly according any preceding clause, wherein the plurality of swirl vanes are curved swirl vanes extending from an upstream end of the flare conical wall outer surface to a downstream end of the flare conical wall outer surface, and extending at least partially in the circumferential direction about the swirler assembly centerline.

The swirler assembly according to any preceding clause, wherein the plurality of swirl vanes are arranged between the flare axial wall outer surface and the dome axial wall inner surface.

The swirler assembly according to any preceding clause, wherein the plurality of swirl vanes are arranged in a plurality of groups about a circumference of the flare, wherein a first group of swirl vanes and a second group of swirl vanes are configured to induce a first swirl number to a flow of the oxidizer, the second group of swirl vanes opposing the first group of swirl vanes circumferentially about the swirler assembly centerline, and a third group of swirl vanes, arranged between the first group of swirl vanes and the second group of swirl vanes, and a fourth group of swirl vanes opposing the third group of swirl vanes circumferentially about the swirler assembly centerline, configured to induce a second swirl number to a flow of the oxidizer, the first swirl number being less than the second swirl number.

The swirler assembly according to any preceding clause, wherein the first group of swirl vanes is arranged on an outer liner side of the flare, and the second group of swirl vanes is arranged on an inner liner side of the flare.

The swirler assembly according to any preceding clause, further comprising an intermediate wall within the flare oxidizer flow passage, the intermediate wall comprising an intermediate axial wall extending circumferentially about the swirler assembly centerline and extending in the longitudinal direction, and an intermediate conical wall connected at a downstream end of the intermediate axial wall and extending circumferentially about the swirler assembly centerline, and extending radially outward and longitudinally downstream from the downstream end of the intermediate axial wall, wherein the flare oxidizer flow passage comprises a flare-side oxidizer flow passage and a dome-side oxidizer flow passage, the flare-side oxidizer flow passage being defined by the flare outer surface and the intermediate wall, and the dome-side oxidizer flow passage being defined by the dome inner surface and the intermediate wall, and wherein the swirl inducing member includes a first swirl inducing member within the flare-side oxidizer flow passage and a second swirl inducing member within the dome-side oxidizer flow passage.

The swirler assembly according to any preceding clause, wherein the first swirl inducing member induces a flare-side swirled flow of the oxidizer and the second swirl inducing member induces a dome-side swirled flow of the oxidizer, the flare-side swirled flow of the oxidizer and the dome-side swirled flow of the oxidizer being in a co-swirl direction with respect to each another.

The swirler assembly according to any preceding clause, wherein the first swirl inducing member induces a flare-side swirled flow of the oxidizer and the second swirl inducing member induces a dome-side swirled flow of the oxidizer, the flare-side swirled flow of the oxidizer and the dome-side swirled flow of the oxidizer being in either a co-swirl direction with respect to each other, or in a counter-swirl direction with respect to each another, and wherein the flare-side swirled flow of the oxidizer being in either a co-swirl direction with a swirl direction of the secondary swirler, or in a counter-swirl direction with the swirl direction of the secondary swirler.

A method of operating a combustor of a gas turbine, the combustor comprising (i) a swirler assembly including (a) a primary swirler, (b) a secondary swirler, (c) a flare connected to the secondary swirler, (d) a dome disposed radially outward of the flare, and (e) an oxidizer flow passage arranged circumferentially between the flare and the dome, wherein a swirl inducing member is disposed within the oxidizer flow passage, (ii) a combustor liner including an outer liner and an inner liner, the outer liner and the inner liner defining a combustion chamber therebetween, and (iii) a fuel nozzle disposed in the swirler assembly, the method comprising: causing an oxidizer to flow through the primary swirler and injecting a fuel from the fuel nozzle into the primary swirler to generate a swirled primary fuel-oxidizer mixture; causing an oxidizer to flow through the secondary swirler and mixing the oxidizer from the secondary swirler with the swirled primary fuel-oxidizer mixture to generate a swirled secondary fuel-oxidizer mixture; causing the swirled secondary fuel-oxidizer mixture to flow from the flare into the combustion chamber; causing an oxidizer to flow through the oxidizer flow passage between the flare and the dome; inducing, by the swirl inducing member, a swirled flow of the oxidizer flowing through the oxidizer flow passage to generate a swirled oxidizer flow into the combustion chamber; and igniting the swirled secondary fuel-oxidizer mixture in the combustion chamber to generate combustion product gases.

The method according to any preceding clause, wherein the inducing induces a flow of oxidizer in a co-swirl direction as a swirl direction of the swirled secondary fuel-oxidizer mixture.

The method according to any preceding clause, wherein the swirl inducing member comprises a plurality of swirl vanes circumferentially disposed within the oxidizer flow passage.

The method according to any preceding clause, wherein the swirl inducing member comprises a plurality of swirl vanes arranged circumferentially within the oxidizer flow passage, and wherein the inducing the swirled flow of the oxidizer through the oxidizer flow passage comprises: inducing, by a first group of swirl vanes among the plurality of swirl vanes, and a second group of swirl vanes circumferentially opposing the first group of swirl vanes, a first swirled flow of the oxidizer with a first swirl number; and inducing, by a third group of swirl vanes among the plurality of swirl vanes, and a fourth group of swirl vanes circumferentially opposing the third group of swirl vanes, a second swirled flow of the oxidizer with a second swirl number higher than the first swirl number, wherein the third group of swirl vanes is arranged between the first group of swirl vanes and the second group of swirl vanes, and the fourth group of swirl vanes is arranged circumferentially opposed to the third group of swirl vanes and is arranged between the first group of swirl vanes and the second group of swirl vanes.

The method according to any preceding clause, wherein the first group of swirl vanes is disposed circumferentially in a first quadrant adjacent to the outer liner, and circumferentially in a second quadrant opposed to the first quadrant and adjacent the inner liner, and the second group of swirl vanes is disposed in a third quadrant between the first quadrant and the second quadrant, and in a fourth quadrant opposing the third quadrant and between the first quadrant and the second quadrant.

The method according to any preceding clause, wherein the oxidizer flow passage includes an intermediate wall between the flare and the dome, the intermediate wall defining a flare-side oxidizer flow passage between the flare and the intermediate wall, and a dome-side oxidizer flow passage between the dome and the intermediate wall, and wherein a flare-side swirl inducing member is disposed within the flare-side oxidizer flow passage, and a dome-side swirl inducing member is disposed within the dome-side oxidizer flow passage, wherein the inducing comprises (a) inducing a flare-side swirled flow of the oxidizer by the flare-side swirl inducing member, and (b) inducing a dome-side swirled flow of the oxidizer by the dome-side swirl inducing member.

The method according to any preceding clause, wherein a swirl direction of the flare-side swirled flow of the oxidizer is opposite a swirl direction of the dome-side swirled flow of the oxidizer.

Although the foregoing description is directed to some exemplary embodiments of the present disclosure, other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A swirler assembly for a gas turbine engine, the swirler assembly defining a swirler assembly centerline therethrough, a longitudinal direction along the swirler assembly centerline, a radial direction extending outward from the swirler assembly centerline, and a circumferential direction about the swirler assembly centerline, the swirler assembly comprising:

a swirler having a primary swirler and a secondary swirler, the secondary swirler being disposed longitudinally downstream of the primary swirler along the swirler assembly centerline;

a flare connected to a downstream end of the secondary swirler, the flare including (i) a flare axial wall extending circumferentially about the swirler assembly centerline and extending in the longitudinal direction, the flare axial wall having a flare axial wall outer surface, and (ii) a flare conical wall connected at a downstream end of the flare axial wall and extending circumferentially about the swirler assembly centerline, and extending radially outward and longitudinally downstream from the downstream end of the flare axial wall, the flare conical wall having a flare conical wall outer surface, wherein the flare axial wall outer surface and the flare conical wall outer surface define a flare outer surface; and a dome disposed radially outward of the flare, the dome including (i) a dome axial wall extending circumferentially about the swirler assembly centerline and extending in the longitudinal direction, the dome axial wall having a dome axial wall inner surface, (ii) a dome conical wall connected at a downstream end of the dome axial wall and extending circumferentially about the swirler assembly centerline, and extending radially outward and longitudinally downstream from the downstream end of the dome axial wall, and (iii) a dome radial wall extending radially outward from a downstream end of the dome conical wall, the dome conical wall having a dome conical wall inner surface, wherein the dome axial wall inner surface and the dome conical wall inner surface define a dome inner surface, wherein a flare oxidizer flow passage is defined by the flare outer surface and the dome inner surface, and wherein the flare oxidizer flow passage includes a swirl inducing member therewithin that induces a swirled flow of an oxidizer passing through the flare oxidizer flow passage into a combustion chamber.

2. The swirler assembly according to claim 1, wherein the swirl inducing member is arranged to induce the swirled flow in a co-swirl direction as a swirl direction of the secondary swirler.

3. The swirler assembly according to claim 1, wherein the swirl inducing member is arranged to induce the swirled flow in a counter-swirl direction as a swirl direction of the secondary swirler.

4. The swirler assembly according to claim 1, wherein the swirl inducing member comprises an annular ring having a plurality of orifices therethrough, wherein an outlet end of each of the plurality of orifices extends at least partially in the circumferential direction so as to provide a tangential flow of the oxidizer therethrough into a combustion chamber.

5. The swirler assembly according to claim 1, wherein at least a portion of the flare outer surface includes corrugations, and wherein at least a portion of the dome inner surface comprises corrugations.

6. The swirler assembly according to claim 1, wherein the swirl inducing member comprises a plurality of swirl vanes.

7. The swirler assembly according to claim 6, wherein the plurality of swirl vanes are arranged between the flare conical wall outer surface and the dome conical wall inner surface.

8. The swirler assembly according claim 7, wherein the plurality of swirl vanes are curved swirl vanes extending from an upstream end of the flare conical wall outer surface to a downstream end of the flare conical wall outer surface, and extending at least partially in the circumferential direction about the swirler assembly centerline.

9. The swirler assembly according to claim 6, wherein the plurality of swirl vanes are arranged between the flare axial wall outer surface and the dome axial wall inner surface.

10. The swirler assembly according to claim 6, wherein the plurality of swirl vanes are arranged in a plurality of groups about a circumference of the flare, wherein a first group of swirl vanes and a second group of swirl vanes are configured to induce a first swirl number to a flow of the oxidizer, the second group of swirl vanes opposing the first group of swirl vanes circumferentially about the swirler assembly centerline, and a third group of swirl vanes, arranged between the first group of swirl vanes and the second group of swirl vanes, and a fourth group of swirl vanes opposing the third group of swirl vanes circumferentially about the swirler assembly centerline, configured to induce a second swirl number to a flow of the oxidizer, the first swirl number being less than the second swirl number.

11. The swirler assembly according to claim 10, wherein the first group of swirl vanes is arranged on an outer liner side of the flare, and the second group of swirl vanes is arranged on an inner liner side of the flare.

12. The swirler assembly according to claim 1, further comprising an intermediate wall within the flare oxidizer flow passage, the intermediate wall comprising an intermediate axial wall extending circumferentially about the swirler assembly centerline and extending in the longitudinal direction, and an intermediate conical wall connected at a downstream end of the intermediate axial wall and extending circumferentially about the swirler assembly centerline, and extending radially outward and longitudinally downstream from the downstream end of the intermediate axial wall, wherein the flare oxidizer flow passage comprises a flare-side oxidizer flow passage and a dome-side oxidizer flow passage, the flare-side oxidizer flow passage being defined by the flare outer surface and the intermediate wall, and the dome-side oxidizer flow passage being defined by the dome inner surface and the intermediate wall, and wherein the swirl inducing member includes a first swirl inducing member within the flare-side oxidizer flow passage and a second swirl inducing member within the dome-side oxidizer flow passage.

13. The swirler assembly according to claim 12, wherein the first swirl inducing member induces a flare-side swirled flow of the oxidizer and the second swirl inducing member induces a dome-side swirled flow of the oxidizer, the flare-side swirled flow of the oxidizer and the dome-side swirled flow of the oxidizer being in a co-swirl direction with respect to each another.

14. The swirler assembly according to claim 12, wherein the first swirl inducing member induces a flare-side swirled flow of the oxidizer and the second swirl inducing member induces a dome-side swirled flow of the oxidizer, the flare-side swirled flow of the oxidizer and the dome-side swirled flow of the oxidizer being in either a co-swirl direction with respect to each other, or in a counter-swirl direction with respect to each another, and wherein the flare-side swirled flow of the oxidizer being in either a co-swirl direction with a swirl direction of the secondary swirler, or in a counter-swirl direction with the swirl direction of the secondary swirler.

15. A method of operating a combustor of a gas turbine, the combustor comprising (i) a swirler assembly including (a) a primary swirler, (b) a secondary swirler, (c) a flare connected to the secondary swirler, the flare including a flare conical wall extending radially outward and in a downstream direction, and having a flare conical wall outer surface, (d) a dome disposed radially outward of the flare, the dome including a dome wall having a dome wall inner surface, and (e) an oxidizer flow passage arranged circumferentially between the flare and the dome, wherein a swirl inducing member is disposed within the oxidizer flow passage between the flare conical wall outer surface and the dome wall inner surface, (ii) a combustor liner including an outer liner and an inner liner, the outer liner and the inner liner defining a combustion chamber therebetween, and (iii) a fuel nozzle disposed in the swirler assembly, the method comprising:

causing an oxidizer to flow through the primary swirler and injecting a fuel from the fuel nozzle into the primary swirler to generate a swirled primary fuel-oxidizer mixture;

causing an oxidizer to flow through the secondary swirler and mixing the oxidizer from the secondary swirler with the swirled primary fuel-oxidizer mixture to generate a swirled secondary fuel-oxidizer mixture;

causing the swirled secondary fuel-oxidizer mixture to flow from the flare into the combustion chamber;

causing an oxidizer to flow through the oxidizer flow passage between the flare and the dome;

inducing, by the swirl inducing member, a swirled flow of the oxidizer flowing through the oxidizer flow passage to generate a swirled oxidizer flow into the combustion chamber; and igniting the swirled secondary fuel-oxidizer mixture in the combustion chamber to generate combustion product gases.

16. The method according to claim 15, wherein the inducing induces a flow of oxidizer in a co-swirl direction as a swirl direction of the swirled secondary fuel-oxidizer mixture.

17. The method according to claim 15, wherein the swirl inducing member comprises a plurality of swirl vanes circumferentially disposed within the oxidizer flow passage.

18. The method according to claim 15, wherein the swirl inducing member comprises a plurality of swirl vanes arranged circumferentially within the oxidizer flow passage, and wherein the inducing the swirled flow of the oxidizer through the oxidizer flow passage comprises:

inducing, by a first group of swirl vanes among the plurality of swirl vanes, and a second group of swirl vanes circumferentially opposing the first group of swirl vanes, a first swirled flow of the oxidizer with a first swirl number; and inducing, by a third group of swirl vanes among the plurality of swirl vanes, and a fourth group of swirl vanes circumferentially opposing the third group of swirl vanes, a second swirled flow of the oxidizer with a second swirl number higher than the first swirl number, wherein the third group of swirl vanes is arranged between the first group of swirl vanes and the second group of swirl vanes, and the fourth group of swirl vanes is arranged circumferentially opposed to the third group of swirl vanes and is arranged between the first group of swirl vanes and the second group of swirl vanes.

19. The method according to claim 18, wherein the first group of swirl vanes is disposed circumferentially in a first quadrant adjacent to the outer liner, and circumferentially in a second quadrant opposed to the first quadrant and adjacent the inner liner, and the second group of swirl vanes is disposed in a third quadrant between the first quadrant and the second quadrant, and in a fourth quadrant opposing the third quadrant and between the first quadrant and the second quadrant.

20. The method according to claim 15, wherein the oxidizer flow passage includes an intermediate wall between the flare and the dome, the intermediate wall defining a flare-side oxidizer flow passage between the flare and the intermediate wall, and a dome-side oxidizer flow passage between the dome and the intermediate wall, and wherein a flare-side swirl inducing member is disposed within the flare-side oxidizer flow passage, and a dome-side swirl inducing member is disposed within the dome-side oxidizer flow passage, wherein the inducing comprises (a) inducing a flare-side swirled flow of the oxidizer by the flare-side swirl inducing member, and (b) inducing a dome-side swirled flow of the oxidizer by the dome-side swirl inducing member.

* * * * *